United States Patent [19]

Salazar

[11] Patent Number: 4,532,675

[45] Date of Patent: Aug. 6, 1985

[54] DOOR HINGE WITH INTEGRAL CHECK

[75] Inventor: Sumorfin Salazar, Toledo, Ohio

[73] Assignee: Ford Motor Company, Dearborn, Mich.

[21] Appl. No.: 640,221

[22] Filed: Aug. 13, 1984

Related U.S. Application Data

[63] Continuation of Ser. No. 378,546, May 17, 1982, abandoned.

[51] Int. Cl.[3] ..... E05D 11/10

[52] U.S. Cl. ..... 16/335; 16/85; 16/374

[58] Field of Search ..... 16/296, 333, 334, 335, 16/344, 347, 374, 85

[56] References Cited

U.S. PATENT DOCUMENTS

| | | | |
|---|---|---|---|
| 2,513,751 | 7/1950 | Semar | 16/85 |
| 2,947,023 | 8/1960 | Hollar | 16/335 |
| 3,370,317 | 2/1968 | Marchione . | |
| 3,710,417 | 1/1973 | Berman et al. | 16/296 |
| 3,931,664 | 1/1976 | Nakano et al. . | |

FOREIGN PATENT DOCUMENTS

| | | | |
|---|---|---|---|
| 1100438 | 9/1955 | France | 16/335 |
| 1186935 | 4/1970 | United Kingdom | 16/335 |

*Primary Examiner*—Fred Silverberg

*Attorney, Agent, or Firm*—Daniel M. Stock; Clifford L. Sadler

[57] ABSTRACT

An automotive door hinge assembly is provided with a hold-open device consisting of a leaf spring carried on the body part of the hinge and a roller carried in a cage portion of the door part which engages the leaf spring only during the portion of its travel proximate the door-open position.

6 Claims, 5 Drawing Figures

DOOR HINGE WITH INTEGRAL CHECK

This application is a continuation of application Ser. No. 378,546, filed May 17, 1982, now abandoned.

BACKGROUND OF THE INVENTION

1. Field of the Invention

The present invention relates generally to automobile door hinges and more specifically such hinges which provide door check means for holding the door in the open position.

2. Description of the Prior Art

It is well known in the automotive door hinge art to provide check spring mechanisms which function to exert a force on the portion of a hinge carrying the door to control movement to and away from the fully open position of the door. For example, the assignee of the present invention employs a hinge in certain of the automobiles it produces which includes a bent-over strike tang on the door portion of the hinge which slides along and compresses a leaf spring member carried on the body portion of the hinge to control movement about the fully open position. While this has been shown to be a simple and effective mechanism, lubrication is required for easy and quiet operation, and the maintaining of contact with the leaf spring during hold-open operation increases the cyclic stress life requirement of the components.

Other examples of prior art hinges may be seen in U.S. Pat. No. 3,370,317 to Marchione and U.S. Pat. No. 3,931,664 to Makano et al. These devices both disclose rather complex structures employing rollers engaging the check spring. Both are disadvantageously complex for some applications and the latter requires significant lubrication to facilitate the long rolling contact of its rollers with its spring.

SUMMARY OF THE INVENTION

Responsive to the disadvantages of the prior art, a simple, effective, economical hinge is provided in which a roller member is carried by the door part of the hinge to engage a preloaded leaf spring only during that part of the door's travel close to the door-open position. The spring is then engaged in smooth rolling contact until the roller passes over a bent-over detent portion of the spring, which captures the roller, and hence the door, to resist movement to the closed position. This cooperative action of the roller and spring reduces component loading and with proper material choice obviates the need for lubrication of the hold-open mechanism.

BRIEF DESCRIPTION OF THE DRAWINGS

Other objects, features, and advantages of the present invention will become readily apparent to those skilled in the automotive door hinge art from the following description, reference being made to the accompanying drawing in which.

DESCRIPTION OF A PREFERRED EMBODIMENT

Figure 1:
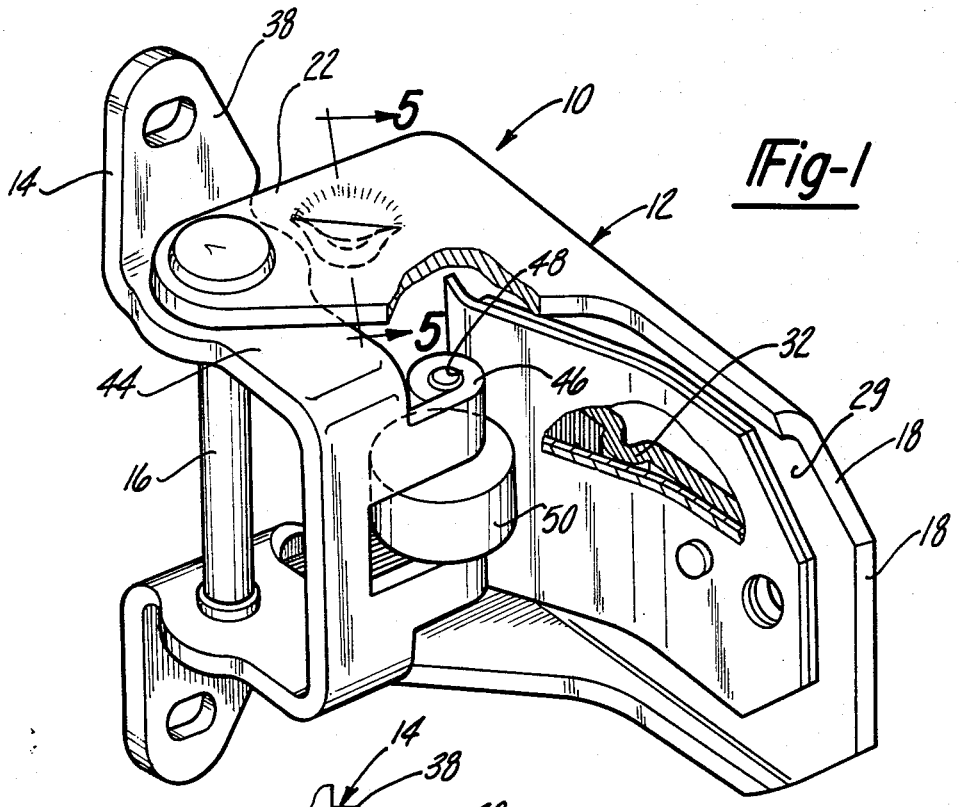
FIG. 1 is a perspective view, partly sectioned for clarity, of the hinge of the present invention in the door-closed position.
Figure 2:
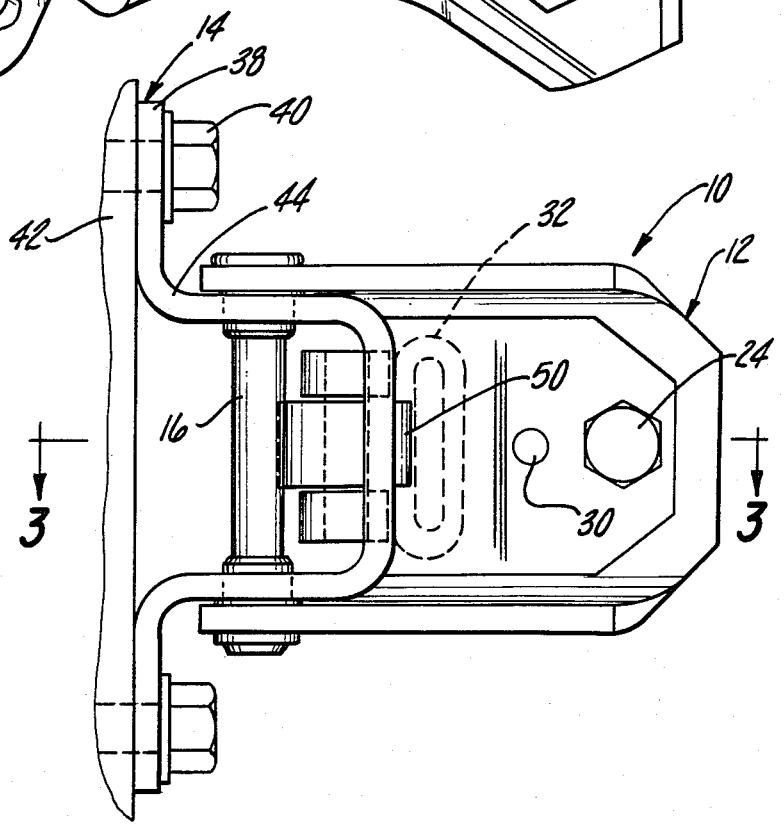
FIG. 2 is a top elevational view of the hinge of the present invention as installed in the door-closed position.

Referring now to the drawings and in particular to FIG. 1 thereof, a hinge assembly 10 is illustrated as comprising generally a body plate 12 and a door plate 14 pivotally interconnected through a pintle pin 16.

Figure 3:
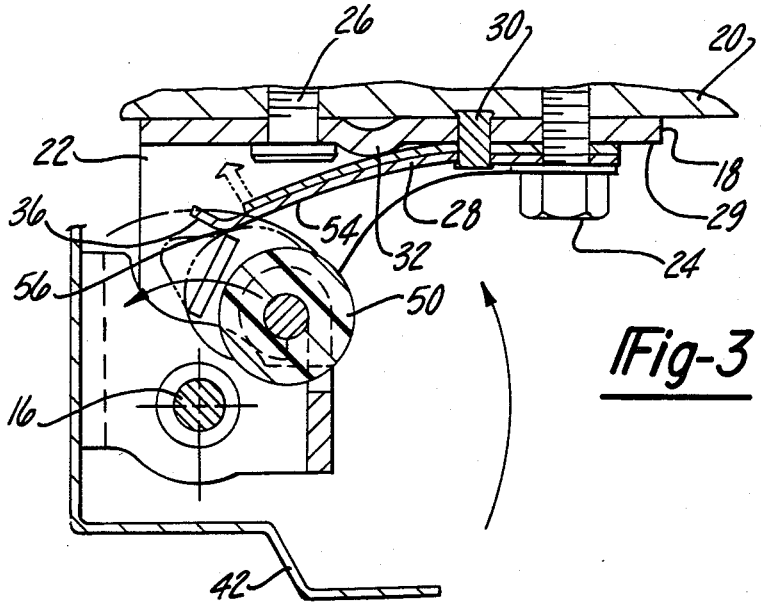
FIG. 3 is a cross-sectional view of the hinge of the present invention in the door-closed position taken along line 3—3 of FIG. 2.
Figure 4:
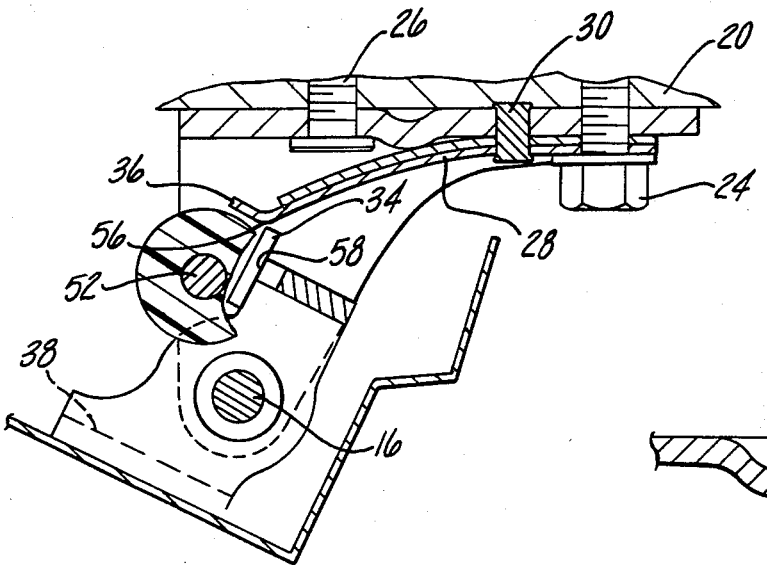
FIG. 4 is a cross-sectional view similar to FIG. 3 wherein the hinge of the present invention is shown in the door-open position, certain parts being broken away for clarity.
Figure 5:
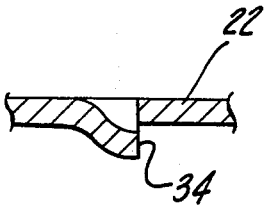
FIG. 5 is a cross-sectional view taken along line 5—5 of FIG. 1.

The body plate 12, as may best be seen in FIGS. 3 and 4, includes a flat mounting portion 18 for abuttingly engaging a portion of the vehicle body 20 and further includes upstanding bracket portions 22 for mounting the pintle pin 16. Attachment of the mounting portion 18 to the vehicle body 20 is preferably effected by conventional fasteners such as indicated at 24 and 26 in FIG. 3. A leaf spring member 28 is secured to the outer face 29 of the mounting part 18 by means of a rivet 30 in cooperation with the fastener 24. The leaf spring 28 is preferably formed of two plates conventionally bonded together and is of generally curved configuration. It is urged generally outwardly toward the vertical pivotal axis of pintle pin 16 by provision of a projection 32 formed by stamping or like process in the mounting part 18. A pair of stop portions 34 are formed in the brackets 22 of the body plate 12 adjacent the free end of the leaf spring member 28 which includes a bent-over detent portion 36.

Considering the door plate 14 now in greater detail, it is illustrated as including a pair of mounting ears 38 through which conventional fasteners 40 are inserted for fastening to a portion of the door 42 of the vehicle. The door plate 14 further includes a cage portion 44 which is configured to receive the pintle pin 16 and which includes a pair of depending rolled-over tabs 46 for defining a pair of aligned apertures 48 for rotatively mounting a roller 50. The roller 50 is preferably formed from reinforced nylon and is mounted on a pin 52 carried in the aperture 48 of cage portion 44.

OPERATION OF THE PREFERRED EMBODIMENT

Operation of the preferred embodiment can best be appreciated by reference to FIGS. 3 and 4 in which the closed and open positions of the hinge assembly 10 are illustrated. It can be seen that in the door-closed position of FIG. 3 the roller 50 carried in cage portion 44 of the door plate 14 is spaced from the upper surface 54 of the leaf spring member 28. Upon movement of the door 42 toward the open position of FIG. 4. the roller 50 is brought into engagement with the surface 54 as is shown in dotted line in FIG. 3 and deflects the leaf spring member 28 inwardly toward the body 20 of the vehicle. Upon reaching the edge 56 defining the terminus of the detent portion 36 of the leaf spring member 28, the roller 50, maintaining rolling contact with the leaf spring member 28, rolls down the detent portion 36 and further movement of the door brings the roller 50 free of the leaf spring member 28 as is shown in FIG. 4. Counterclockwise movement toward the closed position from the open position of FIG. 4 is resisted by the leaf spring member 28 when the roller 50 engages the detent portion 36. Movement in the opening direction is limited by the stops 34 which are abuttingly engageable with edges 58 of cage portion 44.

It has been found that the operation described proceeds smoothly owing to the minimal rolling contact between the roller 50 and the leaf spring member 28 and it has been further found that lubrication of the upper surface of the roller 50 in this application is usually unnecessary. It has also been found that the minimal portion of the travel of the door 42 during which loading contact is effected between the roller 50 and the leaf spring member 28 enhances the life of the components of the hinge assembly 10 by reducing the loading cycle of the hinge assembly 10 during this mode of operation.

While only one embodiment of the present invention has been described, it will be clear to those skilled in the automotive door hinge arts that others may be possible without departing from the scope of the appended claims.

What is claimed is:

1. In an improved hinge assembly of the type having a body plate adapted to be secured to the body of a vehicle, a door plate pivotally connected about a vertical hinge axis to the body plate and adapted to be secured to a door of the vehicle, and a check spring mounted on one of the plates operatively engageable with a striker member carried by the other of the plates to hold the door plate in a door-open position, the improvement wherein:

the check spring comprises a curved resilient spring member having an end fixed to said body plate and another, free end located at a position intermediate said body plate and said door plate and proximate the point of pivotal connection of the body plate and the door plate and having a detent portion bent over in a direction away from said striker member at said free end toward said body plate; and the striker member comprises a roller member rotatably mounted on said door plate about another vertical axis displaced from said vertical hinge axis, said roller member being operative upon movement of said door plate from a door-closed position wherein said roller is spaced from said spring member to said door-open position to engage said spring member in rolling contact to effect deflection thereof until passing over said detent portion, whereupon said roller member is moved completely free of said detent portion and out of contact with said spring member and further away from said detent portion and said spring member during all further movement toward and into said door-open position and reverse movement of said door plate is resisted by said spring member when the roller is moved in the reverse direction into engagement with the detent portion, movement into the door open position is limited by stops formed in the side of the body plate when said stops are abuttingly engaged with edges of the door plate.

2. An improved hinge assembly according to claim 1 wherein said roller member is formed from reinforced nylon.

3. An improved hinge assembly according to claim 1 and further comprising means defining a projection on said body plate in registration with a portion of said check spring for urging said check spring free end to said intermediate position.

4. An improved hinge assembly according to claim 1 wherein said check spring comprises a leaf spring member formed from a plurality of leaf plates.

5. A hinge assembly for an automobile door comprising:

a body plate adapted to be secured to the body of the automobile, a door plate pivotally connected to said body plate about a vertical hinge axis defined by pintle pin means carried between said body plate and said door plate and adapted to be secured to the door, a curved leaf spring member secured to said body plate at one end and having a free end positioned intermediate said door plate and said body plate proximate said pintle pin means, means defining a detent portion at said leaf spring free end bent over toward said body plate and away from said door plate, means defining an integral cage portion of said door plate having a bent-over tab portion defining a vertical axis displaced from said vertical hinge axis; and a roller member mounted in said tab portion for rotation about said tab portion vertical axis and moveable with said door plate from a door-closed position wherein said roller member is spaced from said leaf spring member toward a door-open position to first engage said leaf spring member in rolling contact to effect deflection thereof until passing over and moving completely free from said detent portion and out of contact with said spring member and further away from said detent portion and said spring member during all further movement toward and into said door-open position, whereupon reverse movement of said door plate is resisted by said spring member when the roller is moved in the reverse direction into engagement with the detent portion, movement into the door open position is limited by stops formed in the side of the body plate when said stops are abuttingly engaged with edges of the door plate.

6. A hinge assembly as defined in claim 5 wherein said roller member is formed from reinforced nylon.

* * * * *